US008613494B2

(12) United States Patent
Uchida et al.

(10) Patent No.: US 8,613,494 B2
(45) Date of Patent: Dec. 24, 2013

(54) PRINT METHOD, PRINT DEVICE, AND PROGRAM

(71) Applicant: Seiko Epson Corporation, Tokyo (JP)

(72) Inventors: Yasutaka Uchida, Nagano (JP); Naoki Sudo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/739,102

(22) Filed: Jan. 11, 2013

(65) Prior Publication Data

US 2013/0182042 A1 Jul. 18, 2013

(30) Foreign Application Priority Data

Jan. 13, 2012 (JP) ..... 2012-004828
Oct. 16, 2012 (JP) ..... 2012-228635

(51) Int. Cl.
*B41J 29/38* (2006.01)

(52) U.S. Cl.
USPC ..... 347/41

(58) Field of Classification Search
USPC ..... 347/12, 15, 43, 41; 358/1.2, 1.9
See application file for complete search history.

(56) References Cited

U.S. PATENT DOCUMENTS 5,844,585 A * 12/1998 Kurashima et al. ..... 347/43
6,354,689 B1 * 3/2002 Couwenhoven et al. ..... 347/19
7,399,049 B2 * 7/2008 Jahana et al. ..... 347/19

FOREIGN PATENT DOCUMENTS

JP 2001-146032 A 5/2001

* cited by examiner

*Primary Examiner* — Lamson Nguyen
(74) *Attorney, Agent, or Firm* — Global IP Counselors, LLP

(57) ABSTRACT

A print device for moving a print head in a scanning direction and printing image data onto a print medium includes a color nozzle row, which is a nozzle row in which nozzles for ejecting P (where P is an integer 2 or higher) types of color ink are arranged side by side in a direction intersecting with the scanning direction, wherein the color nozzle row is constituted of P color nozzle groups, and a black nozzle row, which is a nozzle row in which nozzles for ejecting black ink are arranged side by side in parallel with the direction intersecting with the scanning direction and in parallel with the color nozzle row, wherein the black nozzle row is constituted of P black nozzle groups.

12 Claims, 11 Drawing Sheets

| Raster Number | (Pass 1) Outgoing Path | | (Pass 2) Return Path | | (Pass 3) Outgoing Path | | (Pass 4) Return Path | | (Pass 5) Outgoing Path | | (Pass 6) Return Path | |
|---|---|---|---|---|---|---|---|---|---|---|---|---|
| 1 | C1 | BK13 | M1 | | Y1 | | | | | | | |
| 2 | C2 | BK14 | M2 | | Y2 | | | | | | | |
| 3 | C3 | BK15 | M3 | | Y3 | | | | | | | |
| 4 | C4 | BK16 | M4 | | Y4 | | | | | | | |
| 5 | C5 | BK17 | M5 | | Y5 | | | | | | | |
| 6 | C6 | BK18 | M6 | | Y6 | | | | | | | |
| 7 | | | C1 | BK13 | M1 | | Y1 | | | | | |
| 8 | | | C2 | BK14 | M2 | | Y2 | | | | | |
| 9 | | | C3 | BK15 | M3 | | Y3 | | | | | |
| 10 | | | C4 | BK16 | M4 | | Y4 | | | | | |
| 11 | | | C5 | BK17 | M5 | | Y5 | | | | | |
| 12 | | | C6 | BK18 | M6 | | Y6 | | | | | |
| 13 | | | | | C1 | BK13 | M1 | | Y1 | | | |
| 14 | | | | | C2 | BK14 | M2 | | Y2 | | | |
| 15 | | | | | C3 | BK15 | M3 | | Y3 | | | |
| 16 | | | | | C4 | BK16 | M4 | | Y4 | | | |
| 17 | | | | | C5 | BK17 | M5 | | Y5 | | | |
| 18 | | | | | C6 | BK18 | M6 | | Y6 | | | |
| 19 | | | | | | | C1 | BK13 | M1 | | Y1 | |
| 20 | | | | | | | C2 | BK14 | M2 | | Y2 | |
| 21 | | | | | | | C3 | BK15 | M3 | | Y3 | |
| 22 | | | | | | | C4 | BK16 | M4 | | Y4 | |
| 23 | | | | | | | C5 | BK17 | M5 | | Y5 | |
| 24 | | | | | | | C6 | BK18 | M6 | | Y6 | |
| 25 | | | | | | | | | C1 | BK13 | M1 | |
| 26 | | | | | | | | | C2 | BK14 | M2 | |
| 27 | | | | | | | | | C3 | BK15 | M3 | |
| 28 | | | | | | | | | C4 | BK16 | M4 | |
| 29 | | | | | | | | | C5 | BK17 | M5 | |
| 30 | | | | | | | | | C6 | BK18 | M6 | |
| 31 | | | | | | | | | | | C1 | BK13 |
| 32 | | | | | | | | | | | C2 | BK14 |
| 33 | | | | | | | | | | | C3 | BK15 |
| 34 | | | | | | | | | | | C4 | BK16 |
| 35 | | | | | | | | | | | C5 | BK17 |
| 36 | | | | | | | | | | | C6 | BK18 |

Secondary Scanning Direction (Paper Feed Direction)

Fig. 4

PRINT METHOD, PRINT DEVICE, AND PROGRAM

CROSS-REFERENCE TO RELATED APPLICATIONS

This application claims priority to Japanese Patent Application No. 2012-004828 filed on Jan. 13, 2012 and Japanese Patent Application No. 2012-228635 filed on Oct. 16, 2012. The entire disclosure of Japanese Patent Application Nos. 2012-004828 and 2012-228635 is hereby incorporated herein by reference.

BACKGROUND

1. Technical Field

The present invention relates to a print method, a print device, and a program.

2. Background Technology

An inkjet printer that ejects ink from a print head has become a widespread form of an output device for a computer. Especially in recent years, a color printer that uses color ink has also been widely utilized. For example, as is described in Patent Citation 1, there is one color printer in which a plurality of nozzle groups for ejecting different inks are arrayed in a secondary scanning direction on a print head of the color printer. In Patent Document 1, a nozzle row in which a nozzle group for black ink is arrayed in the secondary scanning direction and a nozzle row in which a nozzle group for color inks of respective colors is arrayed in the secondary scanning direction are provided to the print head.

Japanese Laid-open Patent Publication No. 2001-146032 (Patent Document 1) is an example of the related art.

SUMMARY

Problems to Be Solved by the Invention

However, in a printing method for the color printer described in Patent Citation 1, a difference in the order in which the black ink and the respectively colored inks overlap arises between a print surface on an outgoing path and the print surface on a return path in a case where bidirectional printing is to be carried out during color printing, and as a result, a problem has emerged in that an unevenness occurs in the print surface.

Having been contrived in order to resolve the above-mentioned problem at least in part, the present invention can be implemented as the aspects and application examples described below.

FIRST APPLICATION EXAMPLE

The print method as in the present application example is a print method for moving a print head in a primary scanning direction and printing image data onto a print medium, the method being characterized in that the print head includes: a black row, which is a nozzle row in which M (where M is an integer 2 or higher) nozzles for ejecting black ink are arranged side by side in a secondary scanning direction, the black row being constituted of Q (where Q is an integer 2 or higher) black-ink nozzle groups; and a color row, which is a nozzle row in which N (where N is an integer 2 or higher) nozzles for ejecting P (where P is an integer 2 or higher) types of ink are arranged in parallel with the black row, the color row being constituted of P color-ink nozzle groups; and in a case where the amount of ink to be ejected from the black row is a specified value or greater, the image data intended for the black row is allocated to each of the black-ink nozzle groups.

According to the present application example, in a case where the amount of ink to be ejected from the black row is a specified value or greater, the image data intended for the black row is allocated to each of the black-ink nozzle groups, whereby the printing at the black row can be deployed to each of the black-ink nozzle groups. This makes it possible to curb the occurrence of unevenness in the print surface, even in a case where a difference in the order in which the black ink and the respectively colored inks overlap arises between the print surface on an outgoing path and the print surface on a return path.

SECOND APPLICATION EXAMPLE

In the print method set forth in the above-described application example, preferably, the image data intended for the black row is allocated to one of the black-ink nozzle groups in a case where the amount of ink to be ejected from the black row is less than a specified value.

According to the present application example, the image data intended for the black row is allocated to one of the black-ink nozzle groups in a case where the amount of ink to be ejected from the black row is less than a specified value. This makes it possible to accelerate the print speed by printing from a single black-ink nozzle group in a case where the amount of ink to be ejected is small and where unevenness in the print surface is not conspicuous even though a difference in the order in which the black ink and respectively colored inks overlap can arise.

THIRD APPLICATION EXAMPLE

In the print method set forth in the above-described application example, preferably, there are Q types of masks, and each of the masks are used to thereby allocate the image data intended for the black row to each of the black-ink nozzle groups.

According to the present application example, Q types of masks are used in the process of allocating the image data intended for the black row to each of the black-ink nozzle groups. For this reason, respective masks corresponding to each of the black-ink nozzle groups can be used, and the image data can be easily deployed to each of the black-ink nozzle groups.

FOURTH APPLICATION EXAMPLE

In the print method set forth in the above-described application example, preferably, there are one each of the black row and of the color row, and M=N and P=Q=3.

According to the present application example, there are one each of the black row and of the color row, whereby the print head can have the minimum required in terms of nozzle rows and a simple configuration can be adopted. Because the number of nozzles in the black row and the number of nozzles in the color row are equal, and because the black row is split into three regions similarly with respect to the regions of the color row, the printing by the black row can be split into three similarly with respect to the printing by the color row. This makes it possible to achieve an image quality having reduced unevenness in comparison to well-known methods, without changing the number of paths in the well-known methods that are required in the process of printing in a case where the color row is split into three.

FIFTH APPLICATION EXAMPLE

In the print method set forth in the above-described application example, preferably, the image data intended for the black row is divided substantially evenly into three parts and the parts are allocated to each of the black-ink nozzle groups.

According to the present application example, the image data intended for the black row is split substantially evenly into three parts and the parts are allocated to each of the black-ink nozzle groups, whereby the printing in the black row can be deployed in a substantially uniformly fashion to each of the black-ink nozzle groups. This makes it possible to reliably curb the occurrence of unevenness in the print surface.

SIXTH APPLICATION EXAMPLE

In the print method set forth in the above-described application example, preferably, the black row constituted of a first black-ink nozzle group positioned at the most downstream side in the secondary scanning direction, a second black-ink nozzle group adjacent to the first black-ink nozzle group, and a third black-ink nozzle group adjacent to the second black-ink nozzle group, and substantially one-fourth of the image data intended for the black row is allocated to the first black-ink nozzle group, substantially one-half of the image data intended for the black row is allocated to the second black-ink nozzle group, and substantially one-fourth of the image data intended for the black row is allocated to the third black-ink nozzle group.

According to the present application example, substantially one-fourth of the image data is allocated to the third black-ink nozzle group, which prints on the initial outgoing path of the print head, substantially one-half of the image data is allocated to the second black-ink nozzle group, which prints on the return path, and substantially one-fourth of the image data is allocated to the first black-ink nozzle group, which prints on the repeat outgoing path. For this reason, on the outgoing path substantially one-half in total of the image data will be printed, and on the return path, too, substantially one-half of the image data will be printed in an identical fashion. This makes it possible for the proportion of black-ink image on the outgoing path and on the return path to be substantially equal on the print surface, and possible for the unevenness on the print surface to be even further lessened.

SEVENTH APPLICATION EXAMPLE

In the print method as set forth in the above-described application example, preferably, the image data intended for the black row is allocated to each of the black-ink nozzle groups in raster units.

According to the present application example, the image data intended for the black row is allocated to each of the black-ink nozzle groups in raster units, whereby the occurrence of unevenness in the print surface can be easily curbed.

EIGHTH APPLICATION EXAMPLE

In the print method as set forth in the above-described application example, preferably, the image data intended for the black row is randomly deployed and allocated to each of the black-ink nozzle groups.

According to the present application example, the image data intended for the black row is randomly deployed and allocated to each of the black-ink nozzle groups, whereby the occurrence of unevenness in the print surface can be dispersed and prevented from being conspicuous.

NINTH APPLICATION EXAMPLE

In the print method as set forth in the above-described application example, preferably, the image data intended for the black row is deployed in a checker shape and is allocated to each of the black-ink nozzle groups.

According to the present application example, the image data intended for the black row is deployed in a checker shape and is allocated to each of the black-ink nozzle groups, whereby the effects of binding in the print surface can be lessened and the occurrence of unevenness can be dispersed and prevented from being conspicuous.

TENTH APPLICATION EXAMPLE

In the print method as set forth in the above-described application example, Preferably, the image data intended for the black row is allocated to the each of the black-ink nozzle groups on the basis of a first mask, and the image data is allocated to the plurality of nozzles belonging to the same black-ink nozzle group on the basis of a second mask.

According to the present application example, the image data intended for the black row is further deployed and allocated to each of the black-ink nozzle groups, whereby the occurrence of unevenness in the print surface can be dispersed and prevented from being conspicuous.

ELEVENTH APPLICATION EXAMPLE

In the print method as set forth in the above-described application example, at least one from among allocation processing based on the first mask and allocation processing based on the second mask can be executed after the image data has been converted to a distribution of dots on the basis of the lightness having been divided for every color.

TWELFTH APPLICATION EXAMPLE

The print method as in the present application example is a print method for moving a print head in a primary scanning direction and printing image data onto a print medium, the method being characterized in that the print head includes: a black row, which is a nozzle row in which M (where M is an integer 2 or higher) nozzles for ejecting black ink are arranged side by side in a secondary scanning direction, the black row being constituted of Q (where Q is an integer 2 or higher) black-ink nozzle groups; and a color row, which is a nozzle row in which N (where N is an integer 2 or higher) nozzles for ejecting P (where P is an integer 2 or higher) types of ink are arranged in parallel with the black row, the color row being constituted of P color-ink nozzle groups; and in a case where the amount of ink to be ejected from the color row is a specified value or greater, the image data intended for the black row is allocated to each of the black-ink nozzle groups.

According to the present application example, in a case where the amount of ink to be ejected from the color row is a specified value or greater, the image data intended for the black row is allocated to each of the black-ink nozzle groups, whereby the printing at the black row can be deployed to each of the black-ink nozzle groups. This makes it possible to curb the occurrence of unevenness in the print surface, even in a case where a difference in the order in which the black ink and the respectively colored inks overlap arises between the print surface on an outgoing path and the print surface on a return path.

THIRTEENTH APPLICATION EXAMPLE

The print device as in the present application example is a print device for printing image data onto a print medium while also moving a print head in a primary scanning direction, the method being characterized in that the print head includes: a black row, which is a nozzle row in which M (where M is an integer 2 or higher) nozzles for ejecting black ink are arranged side by side in a secondary scanning direction, the black row being constituted of Q (where Q is an integer 2 or higher) black-ink nozzle groups; and a color row, which is a nozzle row in which N (where N is an integer 2 or higher) nozzles for ejecting P (where P is an integer 2 or higher) types of ink are arranged in parallel with the black row, the color row being constituted of P color-ink nozzle groups; and in a case where the amount of ink to be ejected from the black row is a specified value or greater, the image data intended for the black row is allocated to each of the black-ink nozzle groups.

According to the present application example, in a case where the amount of ink to be ejected from the black row is a specified value or greater, the image data intended for the black row is allocated to each of the black-ink nozzle groups, whereby the printing at the black row can be deployed to each of the black-ink nozzle groups. This makes it possible to curb the occurrence of unevenness in the print surface, even in a case where a difference in the order in which the black ink and the respectively colored inks overlap arises between the print surface on an outgoing path and the print surface on a return path.

FOURTEENTH APPLICATION EXAMPLE

The program as in the present application example is a print method for printing image data onto a print medium while also moving a print head in a primary scanning direction, the method being characterized in that the print head includes: a black row, which is a nozzle row in which M (where M is an integer 2 or higher) nozzles for ejecting black ink are arranged side by side in a secondary scanning direction, the black row being constituted of Q (where Q is an integer 2 or higher) black-ink nozzle groups; and a color row, which is a nozzle row in which N (where N is an integer 2 or higher) nozzles for ejecting P (where P is an integer 2 or higher) types of ink are arranged in parallel with the black row, the color row being constituted of P color-ink nozzle groups; and in a case where the amount of ink to be ejected from the black row is a specified value or greater, a computer is caused to execute allocation of the image data intended for the black row to each of the black-ink nozzle groups.

According to the present application example, in a case where the amount of ink to be ejected from the black row is a specified value or greater, the image data intended for the black row is allocated to each of the black-ink nozzle groups, whereby the printing at the black row can be deployed to each of the black-ink nozzle groups. This makes it possible to curb the occurrence of unevenness in the print surface, even in a case where a difference in the order in which the black ink and the respectively colored inks overlap arises between the print surface on an outgoing path and the print surface on a return path.

BRIEF DESCRIPTION OF THE DRAWINGS

Referring now to the attached drawings which form a part of this original disclosure:

FIG. 4 is a descriptive diagram illustrating a print method using black rows and color rows in the past;

DETAILED DESCRIPTION OF EXEMPLARY EMBODIMENTS

Modes for carrying out the present invention shall now be described on the basis of the embodiments.

Figure 1:
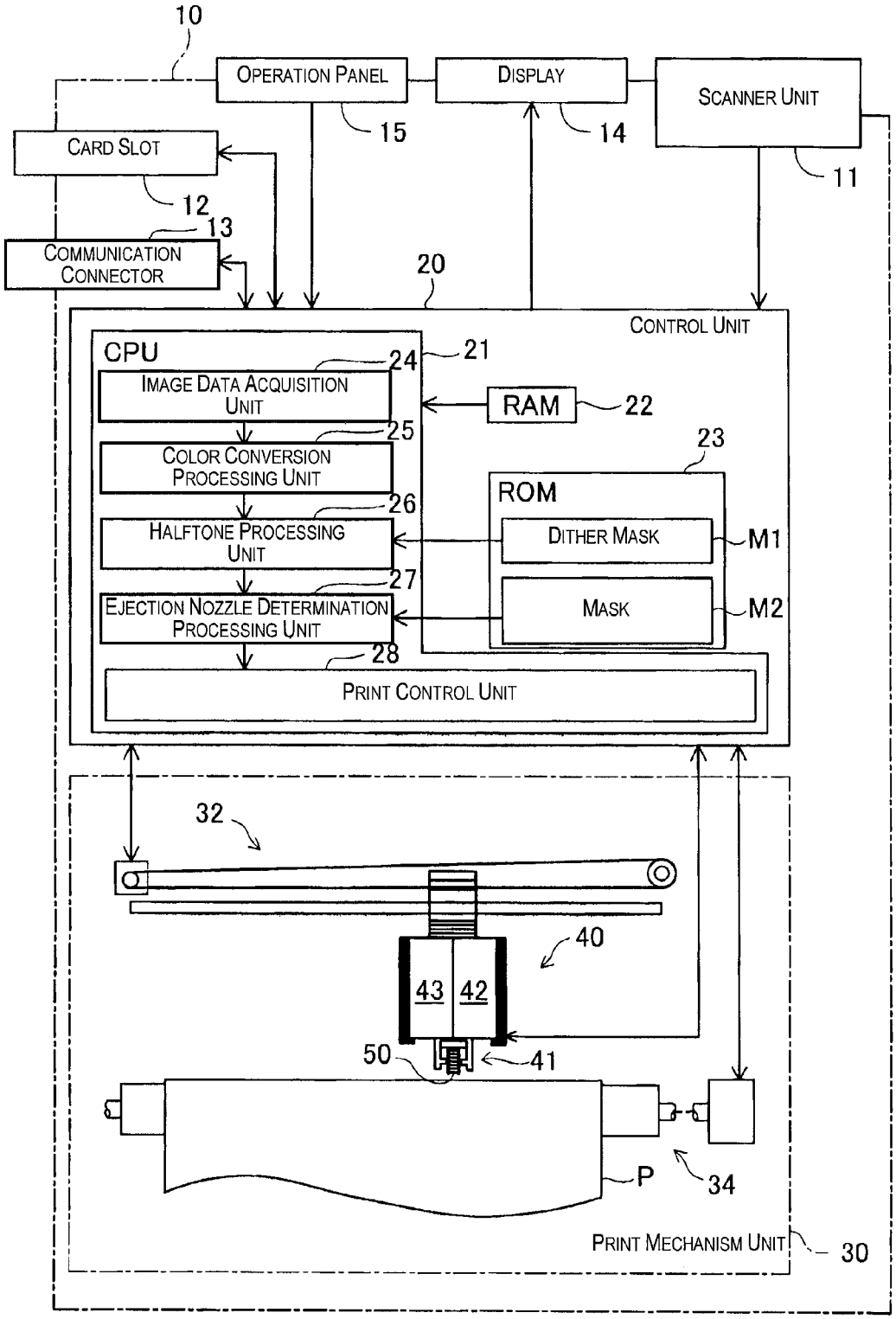
FIG. 1 is a descriptive diagram for describing the configuration of a print device in a first embodiment.

A. First Embodiment (A1) Configuration of the Print Device:

FIG. 1 is a descriptive diagram for describing the configuration of a print device 10 in the first embodiment. The print device 10 is an inkjet-type printer for ejecting ink onto a print medium P to print text, an image, or the like, on the basis of image data. In the first embodiment, the print device 10 has a variety of functionalities, such as scanning and copying, as a multifunction printer.

The print device 10 is provided with a card slot 12 and a communication connector 13. The card slot 12 of the print device 10 is an interface for connecting to a memory card having a built-in storage medium, so as to be able to exchange data therewith. The communication connector 13 is an interface for connecting with a personal computer, a digital camera, a digital video camera, or a similar external device, so as to be able to exchange data therewith. In addition to a function for printing on the basis of a print request from the external device that has been connected to the communication connector 13, the print device 10 also has a function for printing image data that has been stored in the memory card that has been connected to the card slot 12 or in the external device that has been connected to the communication connector 13.

The print device 10 is further provided with a scanner unit 11, a display 14, and an operation panel 15. The scanner unit 11 reads a document that has been placed atop a document tray and converts the document into digital data. The display 14 faces the user and displays text and/or an image. The operation panel 15 receives a command input from the user.

In addition to the above-described card slot 12 and communication connector 13 and the like, the print device is further provided with a control unit 20 for controlling each of the parts of the print device 10 and a print mechanism section for executing printing onto the print medium P.

The control unit 20 is constituted of a CPU 21, a RAM 22, and a ROM 23. The CPU 21 is provided with an image data acquisition unit 24, a color conversion processing unit 25, a halftone processing unit 26, an ejection nozzle determination processing unit 27, and a print control unit 28.

The image data acquisition unit 24 acquires image data from the scanner unit 11, the card slot 12, or the communication connector 13. The color conversion processing unit 25 refers to a color conversion table (not shown) with respect to the acquired image data and divides the image data, which has been inputted by RGB data, into image data for each of the colors cyan, magenta, yellow, and key (black) (CMYK). The halftone processing unit 26 carries out processing for converting the image data to a distribution of dots, on the basis of the lightness of the image data having been divided into each of the colors. In the first embodiment, a dither mask M1 that has been stored in the ROM 23 is used in the halftone processing.

The ejection nozzle determination processing unit 27 determines, for each of the dots of the image data after the halftone processing, from which of the nozzles provided to a print head 50 (described below) the ink is to be ejected to form the dots on the print medium P. Herein, when there is a large amount of ink to be ejected, mask application processing is carried out using a mask M2 that has been stored in the ROM 23 with respect to image data that is intended for a black row RI (described below). The print control unit 28 controls the operations of the print mechanism unit 30 on the basis of the data after processing by the ejection nozzle determination processing unit 27. Each of the forms of processing described above are implemented through the reading out and execution of a program that has been stored in the ROM 23, by the CPU 21. The dither mask M1 and the mask M2 are stored in advance in the ROM 23.

The print mechanism unit 30 is provided with a carriage 40, a head unit 41, a carriage drive unit 32, and a conveyor unit 34. The carriage drive unit 32 drives the carriage 40 in a primary scanning (head scanning) direction. The conveyor unit 23 conveys the print medium P in a secondary direction, which intersects the primary scanning direction in which the carriage 40 moves.

The carriage 40 holds the head unit 41 and has mounted thereon an ink cartridge 42 and an ink cartridge 43. The ink cartridges 42, 43 mounted onto the carriage 40 function as liquid supply units for supplying ink to the head unit 41. The ink cartridge 42 contains black (BK) ink. The ink cartridge 43, however, contains a variety of P different color inks (in the first embodiment, P=3, and the three colors are cyan (C), magenta (M), and yellow (Y)). In the first embodiment, because there are cartridges arranged at two different locations, the number of cartridges that are color cartridges is set to be one, but the number of cartridges that are color cartridges can also be set to be two or more, as a configuration in which there are cartridges arranged at three or more locations.

The head unit 41 is provided with the print unit 50. The print unit 50 is provided with a plurality of nozzles for ejecting ink. Each of the parts of the print head 50, the carriage drive unit 32, and the conveyor unit 34 act in concert on the basis of the control by the control unit 20 to allow the printing onto the print medium P to be implemented.

Figure 2:
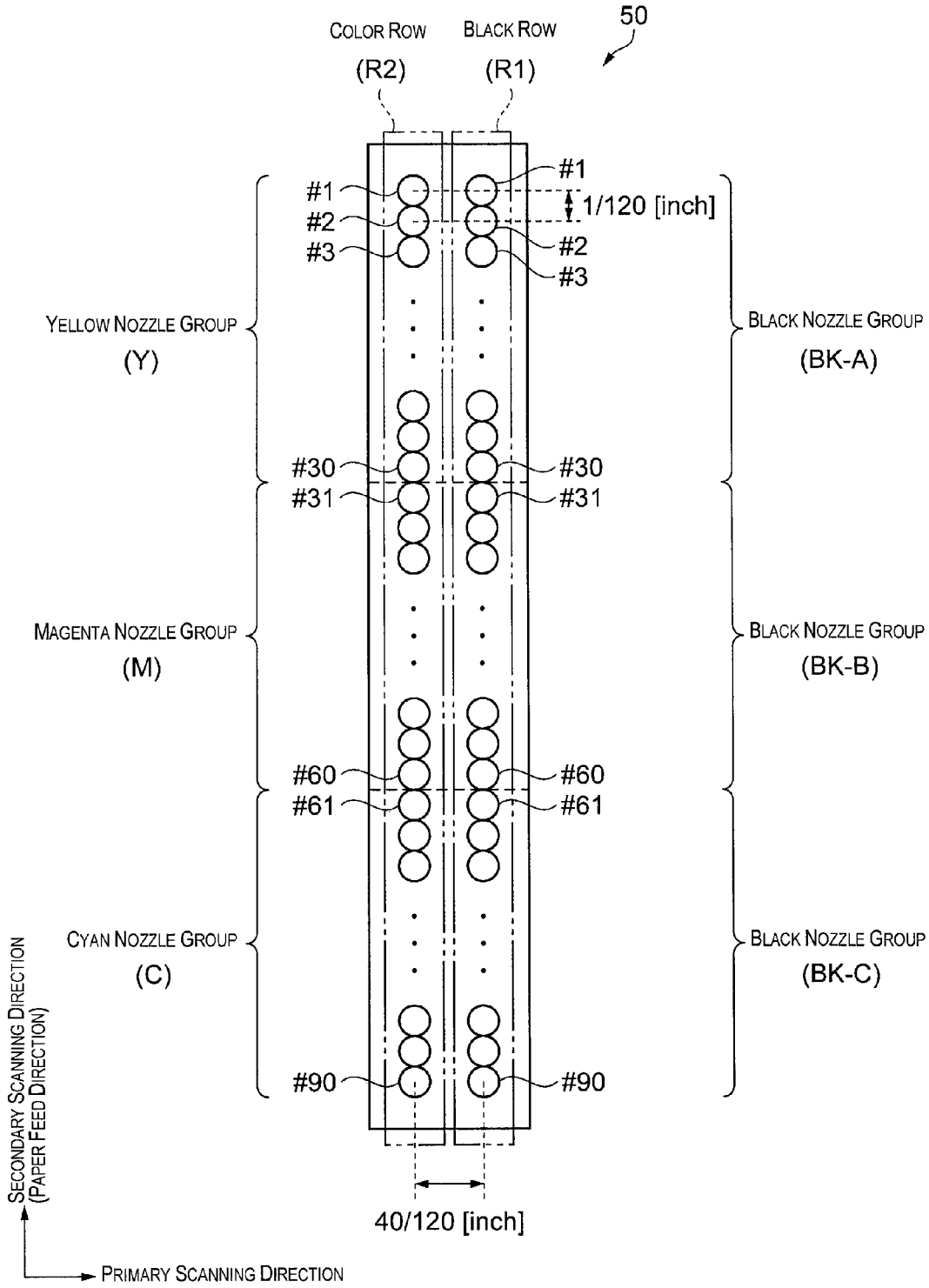
FIG. 2 is a descriptive diagram for describing the arrangement of nozzles in a print head.

FIG. 2 is a descriptive diagram illustrating the arrangement of the nozzles in the print head 50. The print head 50 is provided with a plurality of nozzle rows in which a plurality of nozzles for ejecting ink are arranged side by side in the secondary scanning direction (a paper feed direction). The print head 50 is provided with two nozzle rows, namely, a black row R1 in which M(in the first embodiment, M=90) nozzles #1 to #90 are arrayed in the secondary scanning direction (the paper feed direction), and a color row R2 in which N (in the first embodiment, N=90) nozzles #1 to #90 are arrayed in the secondary scanning direction. The interval between nozzles in the secondary scanning direction is 1/120 (inches) in each of the nozzle rows. The two nozzle rows are arranged in parallel with the primary scanning direction. The black row RI and the color row R2 are arranged so as to be spaced apart at intervals of 40/120 (inches) in the primary scanning direction. In the first embodiment, M=N, meaning that the respective numbers of nozzles in the black row R1 and the color row R2 are the same number.

The black row R1 is constituted of Q (in the first embodiment, Q=3) black-ink nozzle groups BK-A to BK-C. The nozzles #1 to #30 of the black row R1 belong to the black-ink nozzle group BK-A, which serves as a first black-ink nozzle group positioned at the most downstream side in the secondary scanning direction. The nozzles #31 to #60 belong to the black-ink nozzle group BK-B, which serves as a second black-ink nozzle group. The nozzles #61 to #90 belong to the black-ink nozzle group BK-C, which serves as a third black-ink nozzle group. Black ink is supplied from the ink cartridge 42 (see FIG. 1) to each of the black-ink nozzle groups BK-A to BK-C, and the black ink is ejected onto the print medium P from each of the black-ink nozzle groups BK-A to BK-C.

The color row R2, however, is constituted of a yellow nozzle group Y, a magenta nozzle group M, and a cyan nozzle group C, which serve as P (in the first embodiment, P=3) color-ink nozzle groups. The nozzles #1 to #30 of the color row R2 belong to the yellow nozzle group Y. The nozzles #31 to #60 belong to the magenta nozzle group M. The nozzles #61 to #90 belong to the cyan nozzle group C. Yellow ink, magenta ink, and cyan ink are supplied to the yellow nozzle group Y, the magenta nozzle group M, and the cyan nozzle group, respectively, from the ink cartridge 43 (see FIG. 1). The yellow ink, magenta ink, and cyan ink are ejected onto the print medium P from each of the nozzles in the yellow nozzle group Y, each of the nozzles in the magenta nozzle group M, and each of the nozzles in the cyan nozzle group, respectively. In the first embodiment, P=3 and P=Q, meaning that the black row R1 and the color row R2 are both configured to have three discrete nozzle groups.

Figure 3:
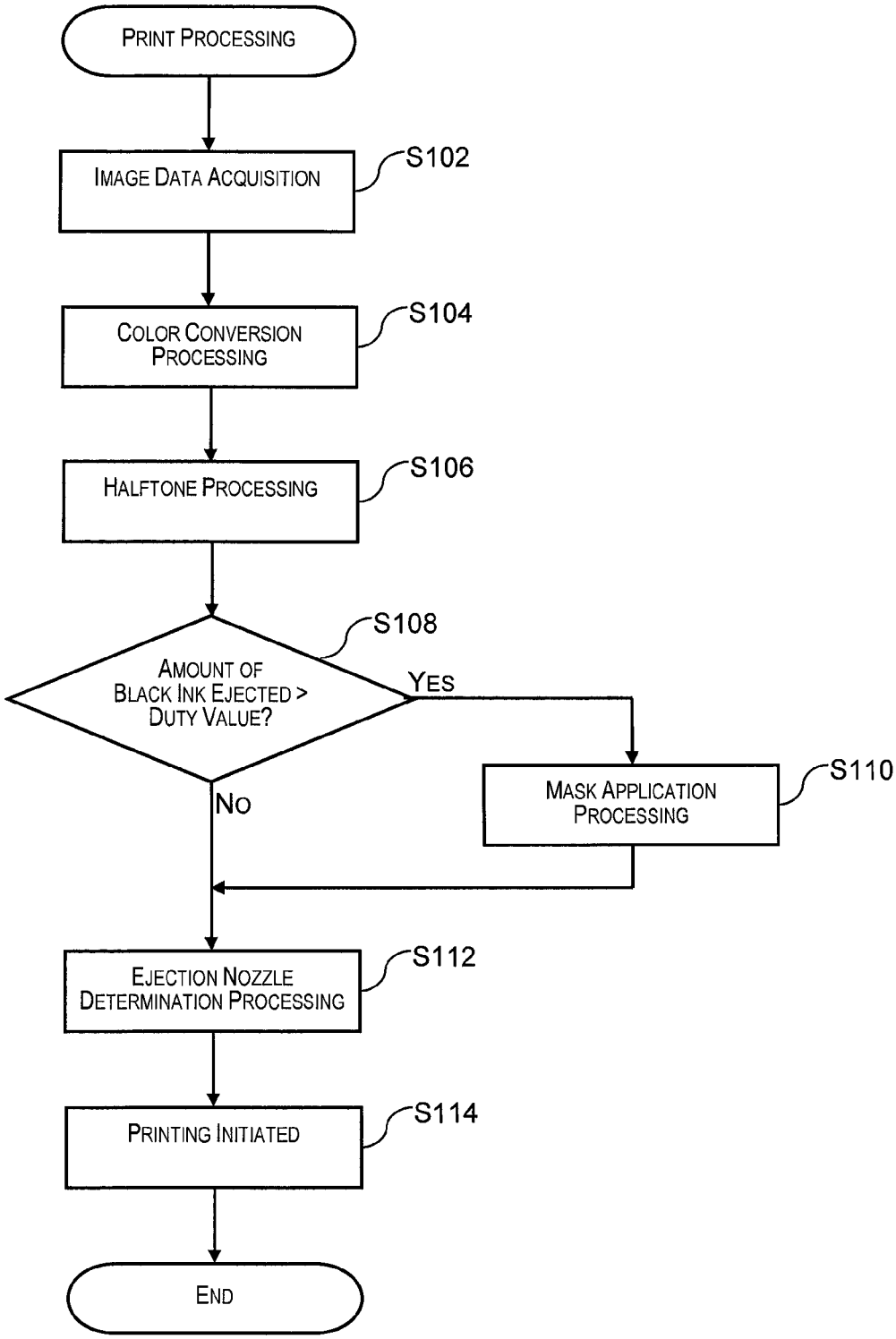
FIG. 3 is a flow chart illustrating the flow of print processing carried out by the print device.

(A2) Print Processing:

The print processing carried out by the print device 10 shall now be described. FIG. 3 is a flow chart illustrating the flow of the print processing carried out by the print device 10. When the print processing is initiated, the CPU 21 acquires image data by the image data acquisition unit 24 via the scanner unit 11, the card slot 12, the communication connector 13, or the like (step S102).

The CPU 21 next carries out the color conversion processing through the color conversion processing unit 25 with respect to the image data that was acquired in step S102, and divides the image data into color image data for each of the colors CMYK (step S104). The CPU 21 then carries out the halftone processing through the halftone processing unit 26 with respect to the image data that was divided in step S104 (step S106). More specifically, the dither mask M1 stored in the ROM 23 is used to convert the lightness value of each of the pixels of the image data to binary data. That is, lightness data is converted to dot data by determining whether or not a dot should be formed with respect to each of the pixels of the image data. In the first embodiment, a known method of ordered dithering is used as the halftone processing. Besides ordered dithering, it would also be possible to utilize another halftone technique, such as an error diffusion method or density pattern method, as the halftone processing. These halftone techniques are well-known techniques and a description thereof has thus been omitted.

The CPU 21 next decides whether or not the amount of ink to be ejected for the image data that is intended for the black row R1 is greater than a Duty value, which serves as a specified value, on the basis of the image data with respect to which the halftone processing was carried out in step S106 (step S108). In the first embodiment, the Duty value is indicative of the amount [of ink] that is to be impacted relative to the total number of pixels. In a case where the amount of ink to be ejected is greater than the Duty value (step S108: Yes), then the flow proceeds to step S110, in which the mask application processing is carried out. In a case where the amount of ink to be ejected is not greater than the Duty value (step S108: No), however, the mask application processing is not carried out, and the flow proceeds to step S112, in which the ejection nozzle determination processing is carried out.

In step S110, the CPU 21 carries out the mask application processing through the ejection nozzle determination processing unit 27 with respect to the image data that is intended for the black row R1 from among the image data with respect to which the halftone processing was carried out in step S106. More specifically, masks 1 to 3 that are included in the mask M2 stored in the ROM 23 are applied to the image data after halftone processing, to generate respective sets of image data (hereinafter called mask image data 1 to 3) after mask application.

In step S112, through the ejection nozzle determination processing unit 27, the CPU 21 allocates each of the sets of mask image data 1 to 3 generated in step S110 to the nozzles of each of the corresponding black-ink nozzle groups BK-A to BK-C in a case where it was decided in step S108 that the amount of ink to be ejected is greater than the Duty value. In a case where it was decided that the amount of ink to be ejected is not greater than the Duty value, however, the image data intended for the black row R1, with respect to which the mask application processing was not carried out, is allocated to the nozzles of the black-ink nozzle group BK-C. The image data can also be allocated not to the nozzles of the black-ink nozzle group BK-C but rather to the nozzles of either the black-ink nozzle group BK-A or the black-ink nozzle group BK-B. The image data intended for the color row R2 from among the image data with respect to which the halftone processing was carried out in step S106 is allocated to the respective nozzles of the yellow nozzle group Y, the magenta nozzle group M, and the cyan nozzle group C constituting the color row R2. Depending on these allocations, the ultimate ON/OFF status of each of the nozzles on the print head 50 is determined (step S112).

The CPU 21 next initiates printing on the basis of the image data with respect to which the ejection nozzle determination processing was carried out in step S112 (step S114). Upon initiation printing, the CPU 21 controls the print mechanism unit 30 through the print control unit 28 in terms of the scanning of the print head 50, the ejection of ink from each of the nozzles of the black row R1 and the color row R2, and the like, on the basis of the image data after the ejection nozzle determination processing, to print the image onto the print medium P. Upon conclusion of the printing of the image onto the print medium P, the CPU 21 then concludes the print processing.

Figures 5A, 5B:
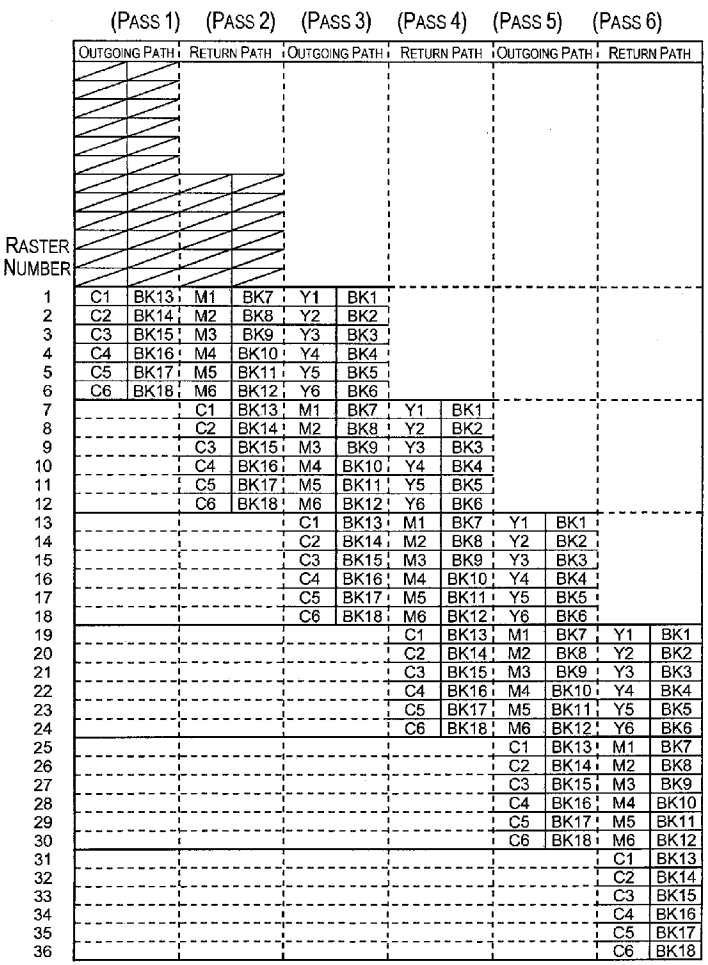
FIGS. 5A and 5B are descriptive diagrams illustrating a print method using black rows and color rows in the first embodiment.

(A3) Print Method:

Print methods in which the black row R1 and color row R2, which have been arrayed on the print head 50, shall now be described. FIG. 4 is a descriptive diagram illustrating a print method in the prior art, in which the black row R1 and the color row R1 are used. FIGS. 5A and 5B are descriptive diagrams illustrating a print method in the first embodiment, in which the black row R1 and the color row R2 are used. In FIGS. 4 and 5, for the sake of convenience of illustration, the black row R1 and the color row R2 are each provided with 18 nozzles. As such, there will be six nozzles each that belong to the three nozzle groups in the black row R1 and in the color row R2.

The primary scanning in the print processing by the print head 50 is illustrated on the horizontal axis as "passes", in a format where initial primary scanning on an outgoing path is a "pass 1", subsequent primary scanning on a return path is a "pass 2", repeat primary scanning on the outgoing path is a "pass 3", and so forth until a pass 6. Also, each of the raster positions in printing are illustrated on the vertical axis as "raster numbers", from 1 to 36. At each of the raster positions, the ejection from each of the nozzles in the yellow nozzle group Y is illustrated as Y1 to Y6, the ejection from each of the nozzles in the magenta nozzle group M is illustrated as M1 to M6, the ejection from each of the nozzles in the cyan nozzle group C is illustrated as C1 to C6, and the ejection from each of the nozzles in the black-ink nozzle groups BK-A, BK-B, and BK-C is illustrated as BK1 to BK6, BK7 to BK12, and BK13 to BK18, respectively.

In the print method of the prior art illustrated in FIG. 4, only the black-ink nozzle group BK-C (BK13 to BK18) is used in the ejection by the black row R1. At the first through sixth rasters, the inks overlap in the order of black, then cyan, then magenta, and finally yellow. At the seventh through twelfth rasters, however, the inks overlap in the order of cyan, then black, then magenta, and finally yellow. In this manner, in the print method of the prior art, the order in which the inks overlap is different between the outgoing path and the return path, whereby a difference in the shading arises and whereby an unevenness occurs within the print surface.

By contrast, in the print method of the first embodiment illustrated in FIG. 5A, the black-ink nozzle group BK-A (BK1 to BK6), the black-ink nozzle group BK-B (BK7 to BK12), and the black-ink nozzle group BK-C (BK13 to BK18) are all used in the ejection by the black row R1. That is, the ejection of black ink is carried out using all of the nozzles of the black row R1. However, when the ejection of black ink is carried out using all of the nozzles of the black row R1 without change, there will be a threefold increase in the amount of black ink that is ejected. For this reason, as is illustrated in FIG. 5B, the ejection nozzles are determined after the mask application processing of the nozzle units using the masks 1 to 3 has been conducted, with respect to the halftoned image data intended for each of the black-ink nozzle groups BK-A to BK-C at the first through sixth rasters, the seventh through twelfth rasters, the thirteenth through eighteenth rasters, and the nineteenth through twenty-fourth rasters, respectively.

Figure 6:
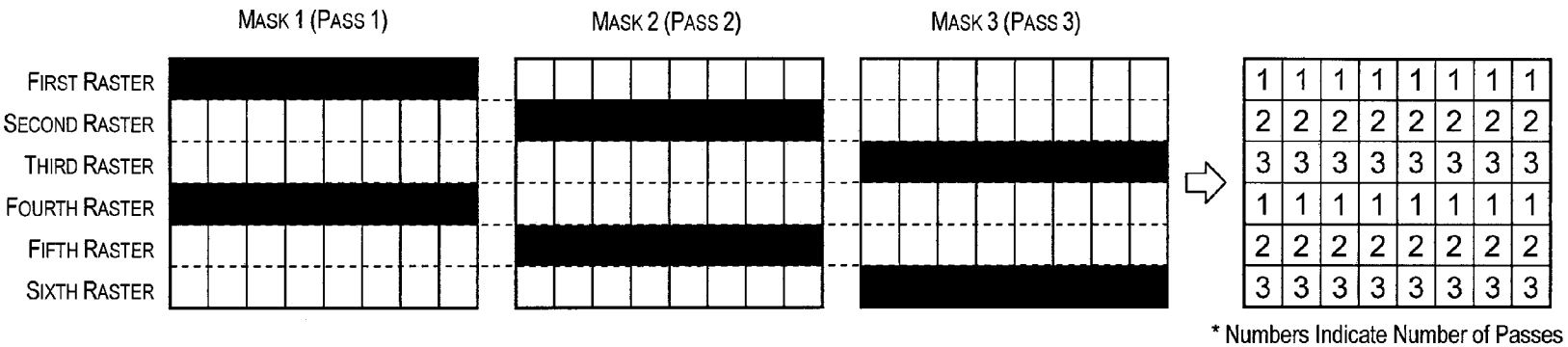
FIG. 6 is a drawing illustrating an example of a mask pattern in the first embodiment.

FIG. 6 is a drawing illustrating an example of the mask patterns in the first embodiment. In FIG. 6, the white portions in each of the masks 1 to 3 are converted to pixels where a dot is not formed on the corresponding pixel portion of the halftoned image data. The black portions in each of the masks 1 to 3, on the other hand, are where the corresponding pixel portion of the halftoned image data remains without change. In FIG. 6, the table on the right side illustrates the number of passes for when the image data is to be printed, in pixel units.

In the mask patterns illustrated in FIG. 6, the black portions in each of the masks 1 to 3 are regularly deployed in raster units. More specifically, the mask 1 has a mask pattern for printing the respective image thereof at the first raster and fourth raster in the pass 1, the mask 2 has a mask pattern for printing the respective image thereof at the second raster and fifth raster in the pass 2, and the mask 3 has a mask pattern for printing the respective image thereof at the third raster and sixth raster in the pass 3. The proportion of black portions in each of the masks 1 to 3 is one-third of the entire image, each. For this reason, the halftoned image data intended for the black row R1 is printed having been deployed in one-third increments over three passes.

In the first embodiment described above, in a case where the amount of ink to be ejected for the image data intended for the black row R1 is greater than the Duty value, the mask application processing using the masks 1 to 3 is carried out with respect to the image data, and the black-ink image is printed having been deployed in one-third increments over three discrete passes. The number of times that the printing by the black row R1 and the printing by the color row R2 overlap is thereby increased, and the ejection of black ink is deployed commensurate therewith. As a consequence thereof, it is possible to curb the occurrence of unevenness within the print surface, so as to prevent the unevenness from being conspicuous, even though a difference in the order in which the black ink and each of the color inks overlap can arise. In a case where the amount of ink to be ejected is not greater than the Duty value, however, an unevenness within the print surface seldom occurs, and thus the black-ink image is printed with one pass, as per the prior art, for which reason the print speed can be accelerated so as to be faster than when printing is performed over three passes.

B. Second Embodiment

Figure 10B:
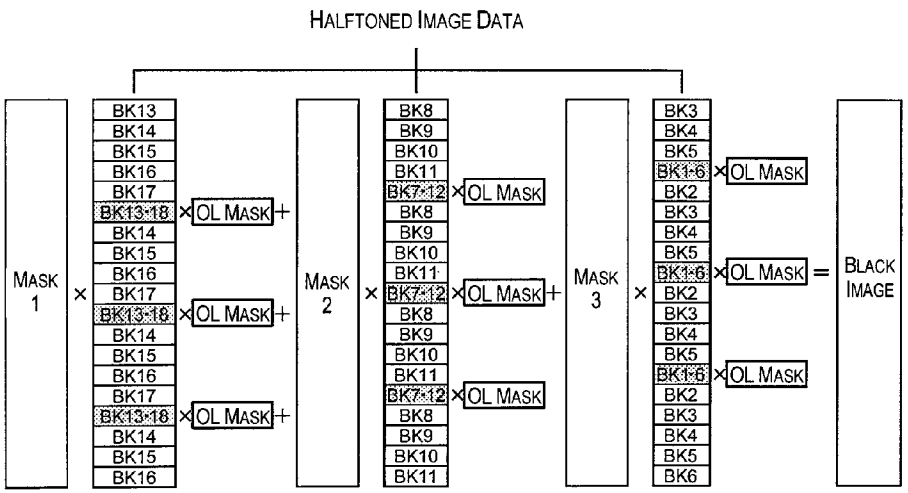
FIGS. 10A and 10B descriptive diagrams illustrating a print method using black rows and color rows in a second embodiment.

The second embodiment of the present invention shall be described next, with reference to FIGS. 10A and 10B. In the description below, portions that are identical to portions that have already been described are assigned identical reference numerals, and a description thereof has been omitted. In the first embodiment, the ejection nozzles for the black ink were determined with respect to the halftoned image data by conducting the mask application processing of the nozzle units using the masks 1 to 3 (first masks) for segmentation processing, but in the second embodiment, mask application processing for overlap printing is also conducted in addition to the mask application processing for segmentation processing.

Figure 10A:
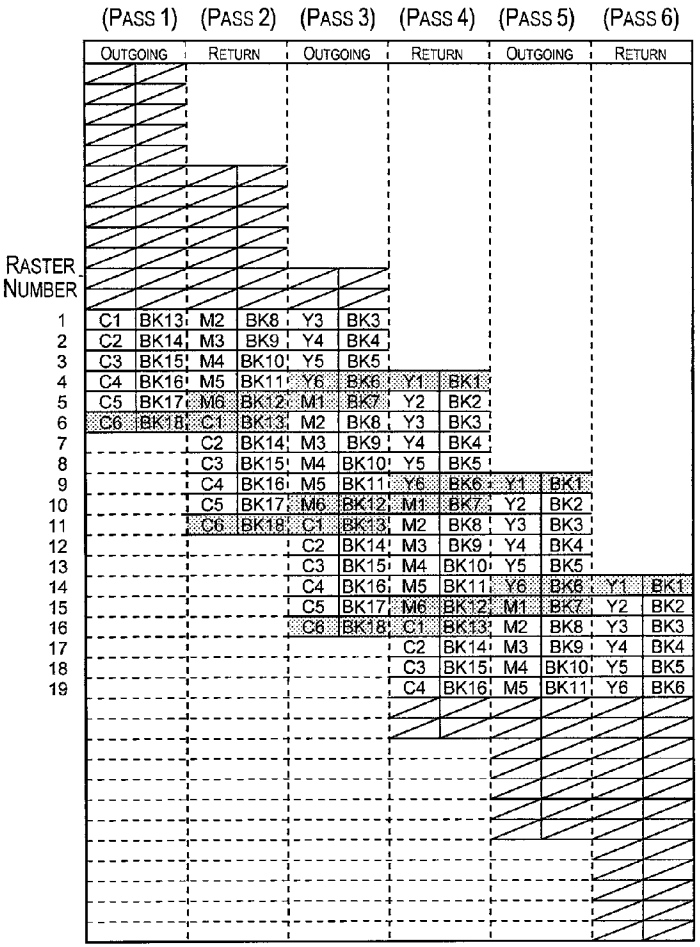

In a print method of the second embodiment, illustrated in FIG. 10A, the black-ink nozzle group BK-A (BK1 to BK6), the black-ink nozzle group BK-B (BK7 to BK12), and the black-ink nozzle group BK-C (BK13 to BK18), i.e., all of the nozzles of the black row R1 are all used in the ejection by the black row R1 to carry out the ejection of the black ink. However, a large quantity of the black ink is ejected when the ejection of the black ink is carried out using all of the nozzles of the black row R1 without change. For this reason, in the second embodiment, the mask application processing for segmentation processing is conducted first; the masks of the nozzle units using the masks 1 to 3 is applied to the halftoned image data intended for each of the black-ink nozzle groups BK-A to BK-C at the first through sixth rasters, the seventh through twelfth rasters, the thirteenth through eighteenth rasters, and the nineteenth through twenty-fourth rasters, respectively.

An overlap (OL) mask for overlap printing is subsequently used to conduct mask application processing. The OL mask is a mask for forming the rasters in the nozzle groups, i.e., the black-ink nozzle group BK-A (BK1 to BK6), the black-ink nozzle group BK-B (BK7 to BK12), and the black-ink nozzle group BK-C, by having the Bk1 and Bk6, Bk7 and Bk12, and Bk13 and Bk18, which belong to the same black-ink nozzle groups, complement each other in the primary scanning direction at different passes. With respect to the ejection of cyan ink, magenta ink, and yellow ink, too, the OL mask is applied to the mutually overlapping C1 and C6, M1 and M6, and Y1 and Y6, as illustrated in FIG. 10A. As such, in the second embodiment, the application of the two types of mask for segmentation processing and for overlap printing makes it possible to form a single raster in the print image with a plurality of different passes, and in addition makes it possible to form the rasters with complementation between the ejection by a leading portion of a black-ink nozzle group (for example, Bk1) and a later portion of the same black-ink nozzle group (for example, Bk6) which is in a different pass. An effect similar to that in the first embodiment can be accomplished in the second embodiment described above as well.

B. Third Embodiment

Figure 11:
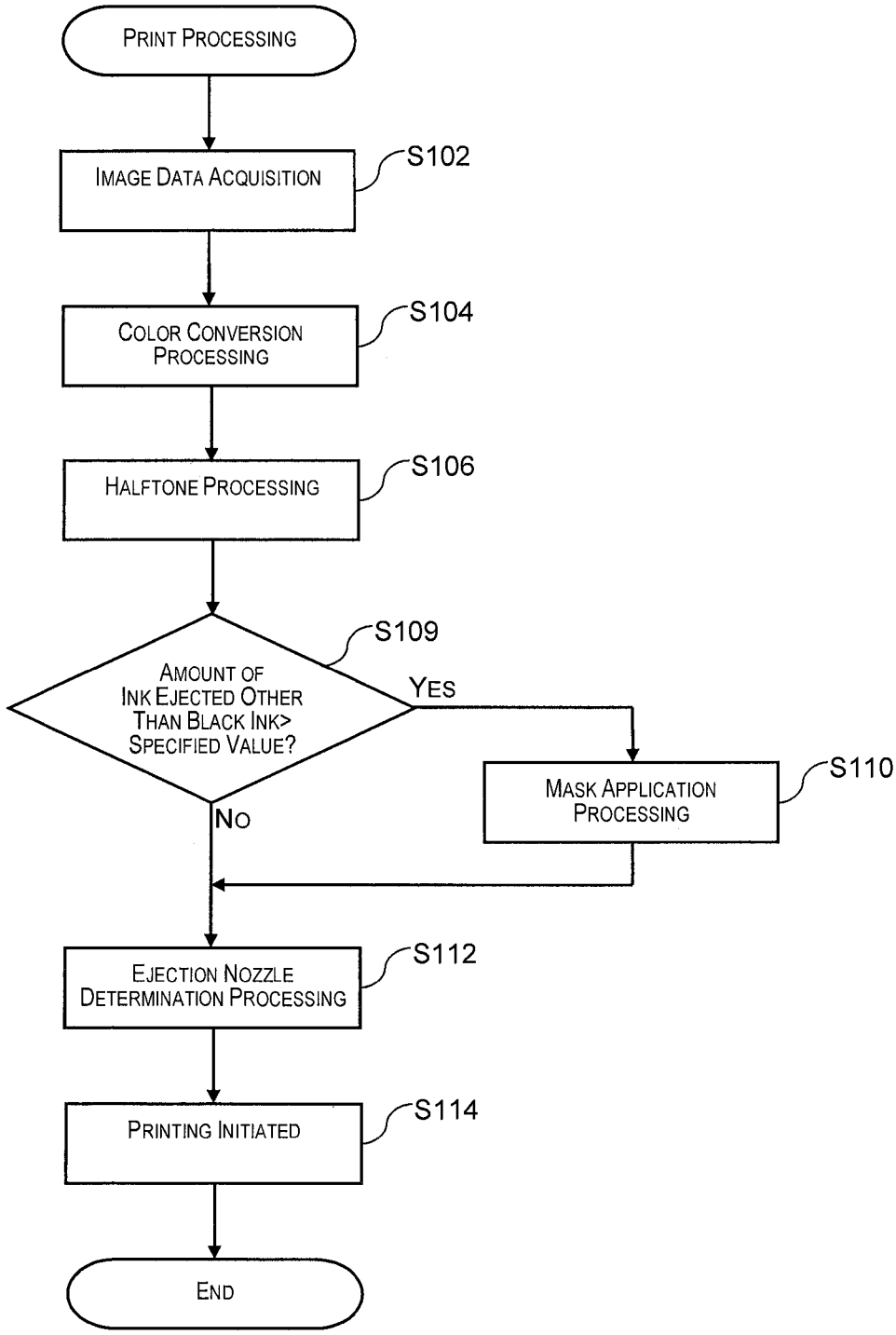
FIG. 11 is a flow chart illustrating the flow of print processing carried out by the print device in the second embodiment.

A third embodiment of the present invention shall be described next, with reference to FIG. 11. In the first embodiment, the decision to execute the mask application processing was carried out on the basis of the amount of black ink to be ejected, but in the third embodiment, a determination to execute the mask application processing is carried out on the basis of a comparison between a specified value and the amount of ink to be injected intended for ink other than black ink, as illustrated in step S109. The mask application processing can also be executed in a case where the result of a comparison between the amount of black [ink] to be ejected and the sum of the amounts of cyan, magenta, and yellow inks to be ejected throughout the entire image shows that the amount of black [ink] to be ejected is greater and where the sum of the amounts of cyan, magenta, and yellow inks to be ejected is greater than a specified value. The mask application processing can further be executed in a case where the amount(s) of one or two inks to be ejected from among the cyan, magenta, and yellow, which are ejected in close proximity to the black, is greater than a specified value within the same pass. The specified value is indicative of the amount [of ink] that is to be impacted relative to the total number of pixels, and is assumed to be, for example, about 50%, but preferably, a detailed specified value is determined in advance on the basis of the amount of ink overlap according to experimentation or the like.

That is, in a case where the amount of color ink intended to be ejected is greater than the specified value in step S109 (a case of "Yes"), the mask application processing (step S110) is executed and the flow proceeds to step S112; in a case where the amounts of each of the inks to be ejected is not greater than the specified value (a case of "No"), the mask application processing (step S110) is not executed, and the flow proceeds to step S112. In this manner, the mask application processing (step S110) is executed in accordance with the amount of ink to be ejected other than the black ink, after the lightness data has been converted to dot data, i.e., after the halftone processing (step S106) has been executed. An effect similar to that in the first embodiment can be accomplished in the third embodiment described above as well. The third embodiment can be a mode that is combined with the first embodiment or can be a mode that is combined with the second embodiment.

C. Modification Examples

The present invention is not to be limited to the embodiments described above; rather, the present invention can be implemented in a variety of different modes within a scope that does not depart from the spirit thereof. For example, modifications as per the following would also be possible.

(B1) First Modification Example

In the embodiments described above, the mask patterns illustrated in FIG. 6 were used to carry out the mask application processing, but there is no limitation thereto, and different mask patterns can also be used. For example, in the mask patterns illustrated in FIG. 7, the black portions in each of the masks 1 to 3 are deployed randomly not in raster units but rather in pixel units. Similarly with respect to the mask patterns in FIG. 6, the proportion of black portions in each of the masks 1 to 3 is one-third of the entire image, each. This manner of randomly distributing the print portions of the image in pixel units causes the unevenness in the print surface to be less conspicuous.

Figure 7:
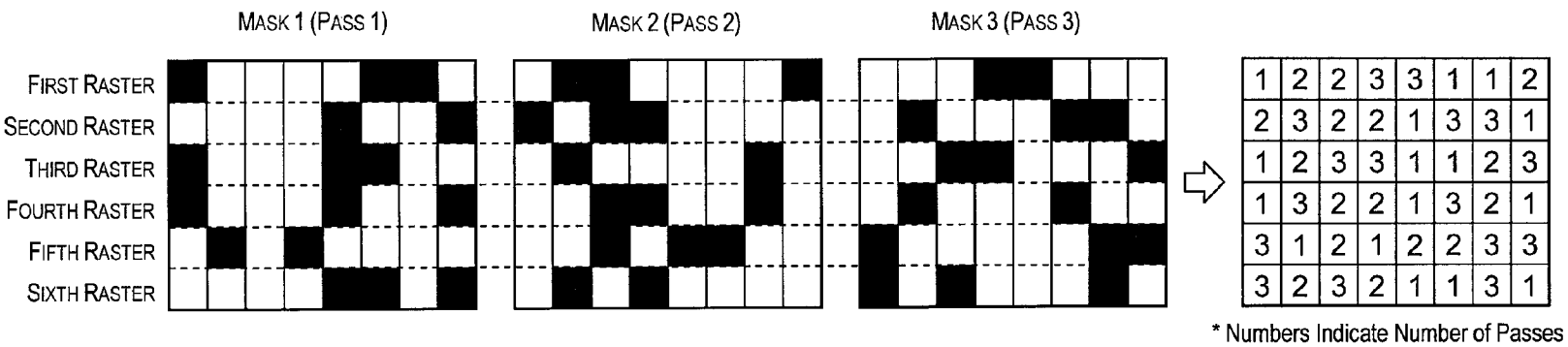
FIG. 7 is a drawing illustrating an example of a mask pattern in a modification example.
Figure 8:
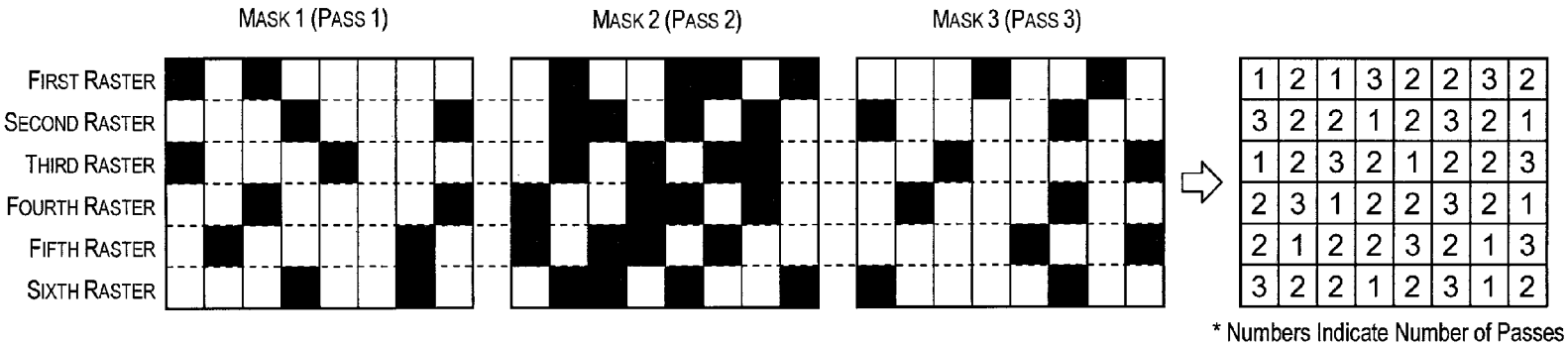
FIG. 8 is a drawing illustrating an example of a mask pattern in a modification example.

Also, in the mask patterns illustrated in FIG. 8, similarly with respect to the mask patterns in FIG. 7, the black portions in each of the masks 1 to 3 are deployed randomly in pixel units. However, unlike the mask patterns described above, the proportion of black portions in each of the masks 1 to 3 is one-fourth of the entire image in the mask 1, i.e., in the initial pass 1 of the outgoing path, one-half of the entire image in the mask 2, i.e., in the pass 2 of the return path, and one-fourth of the entire image in the mask 3, i.e., in the repeat pass 3 of the outgoing path. In this manner, one-half of the image in total will be printed in the outgoing path and, similarly, one-half of the image will be printed in the return path as well. As a consequence thereof, the proportions of the image that are black ink in the outgoing path and the return path will be the same, and the unevenness in the print surface will be even less conspicuous.

Figure 9:
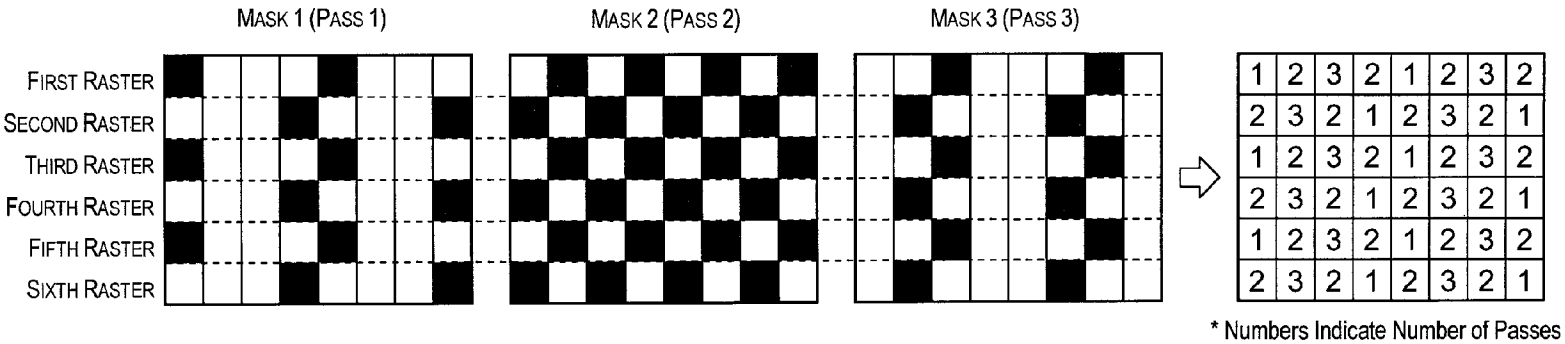
FIG. 9 is a drawing illustrating an example of a mask pattern in a modification example.

Moreover, in the mask patterns illustrated in FIG. 9, the proportion of the black portions in each of the masks 1 to 3 are one-fourth, one-half, and one-fourth of the entire image, similarly with respect to the mask patterns in FIG. 8. However, unlike the mask patterns in FIGS. 7 and 8, the pixels of the black portions in each of the masks 1 to 3 are not deployed randomly but rather are deployed regularly. More specifically, the pixels of the black portions are deployed in a checker shape in which the black portions repeat on and off alternating in the primary scanning direction (the lateral direction in the drawing) and in the secondary scanning direction (the longitudinal direction in the drawing). This manner of regularly distributing the pixels of the print portions so as to be, for example, in a checker shape further reduces the interval between pixels in the print surface and therefore lessens the effects of banding.

(B2) Second Modification Example

In the embodiments described above, the types of color ink was set to P=3, the number of nozzles in the black row R1 was set to M=90, the number of nozzles in the color row R2 was set to N=90, the number of black-ink nozzle groups was set to Q=3, and the number of color-ink nozzle groups was set to P=3. However, there is no limitation thereto, and the types of inks as well as the number of nozzles and number of nozzle groups can be freely set. As for the arrangement and arraying of each of the nozzles and the arrangement and arraying of each of the nozzle groups, there is also no restriction to the forms used in the embodiments described above, and the arrangement and arraying can be freely set.

(B3) Third Modification Example

In the embodiments described above, the mask application processing was carried out with respect to the halftoned image data. However, there is no limitation thereto, and the mask application processing can also be carried out with respect to the not-yet-halftoned image data. In such a case, the halftone processing would be carried out with respect to the image data after mask application processing.

(B4) Fourth Modification Example

Some of the functions that were implemented by software in the embodiments described above can also be implemented with hardware; alternatively, some of the functions that were implemented with hardware can also be implemented with software. Additionally, some of the functions that were implemented with software can also be provided by an external device (for example, a computer) that is connected to the print device 10.

What is claimed is:

1. A print device for moving a print head in a scanning direction and printing image data onto a print medium, the print head comprises:

a color nozzle row, which is a nozzle row in which nozzles for ejecting P (where P is an integer 2 or higher) types of color ink are arranged side by side in a direction intersecting with the scanning direction, the color nozzle row being constituted of P color nozzle groups; and a black nozzle row, which is a nozzle row in which nozzles for ejecting black ink are arranged side by side in parallel with the direction intersecting with the scanning direction and in parallel with the color nozzle row, the black nozzle row being constituted of P black nozzle groups; and in a case where the amount of ink to be ejected from the black nozzle row is a predetermined value or greater, one raster is segmented among each of the black nozzle groups of the black nozzle row, and in a case where the amount of ink to be ejected from the black nozzle row is less than a predetermined value, one raster is printed by any one among the black nozzle groups.

2. The print device as set forth in claim 1, wherein there are P types of masks, and in a case where the amount of ink to be ejected from the black nozzle row is the predetermined value or greater, each of the masks is used to thereby segment one raster among the black nozzle groups and print.

3. The print device as set forth in claim 1, wherein image data that is intended for the black nozzle row is deployed randomly and allocated to each of the black nozzle groups.

4. The print device as set forth in claim 3, wherein the image data intended for the black nozzle row is deployed in a checker shape and allocated to each of the black nozzle groups.

5. The print device as set forth in claim 1, wherein image data intended for the black nozzle row is allocated to each of the black nozzle groups on the basis of a first mask, and the image data is further allocated to the plurality of nozzles belonging to the same black nozzle group on the basis of a second mask.

6. The print device as set forth in claim 5, wherein at least one from among allocation processing based on the first mask and allocation processing based on the second mask is executed after the image data has been converted to a distribution of dots on the basis of the lightness having been divided for every color.

7. The print device as set forth in claim 1, wherein the number of nozzles in any one nozzle group of the color nozzle groups and the number of nozzles in any one nozzle group among the black nozzle groups are the same.

8. The print device as set forth in claim 1, wherein the print head has one each of the black nozzle row and the color nozzle row, and P=3.

9. The print device as set forth in claim 8, wherein the black nozzle row is constituted of a first black-ink nozzle group positioned at the most downstream side in a direction intersecting with the scanning direction, a second black-ink nozzle group adjacent to the first black-ink nozzle group, and a third black-ink nozzle group adjacent to the second black-ink nozzle group, and substantially one-fourth of the image data intended for the black nozzle row is allocated to the first black-ink nozzle group, substantially one-half of the image data is allocated to the second black-ink nozzle group, and substantially one-fourth of the image data is allocated to the third black-ink nozzle group.

10. The print device as set forth in claim 1, wherein the number of nozzles in each of the nozzle groups of the P black nozzle groups is the same number.

11. A print device for moving a print head in a scanning direction and printing image data onto a print medium, the print head comprising:

a color nozzle row, which is a nozzle row in which nozzles for ejecting P (where P is an integer 2 or higher) types of color ink are arranged side by side in a direction intersecting with the scanning direction, the color nozzle row being constituted of P color nozzle groups; and a black nozzle row, which is a nozzle row in which nozzles for ejecting black ink are arranged side by side in parallel with the direction intersecting with the scanning direction and in parallel with the color nozzle row, the black nozzle row being constituted of P black nozzle groups; and in a case where the amount of ink to be ejected from the color nozzle row is a predetermined value or greater, one raster is segmented among each of the black nozzle groups of the black nozzle row, and in a case where the amount of ink to be ejected from the color nozzle row is less than a predetermined value, one raster is printed by any one among the black nozzle groups.

12. A print method for moving a print head in a scanning direction and printing image data onto a print medium, the print head comprising a color nozzle row, which is a nozzle row in which nozzles for ejecting P (where P is an integer 2 or higher) types of color ink are arranged side by side in a direction intersecting with the scanning direction, the color nozzle row being constituted of P color nozzle groups; and a black nozzle row, which is a nozzle row in which nozzles for ejecting black ink are arranged side by side in parallel with the direction intersecting with the scanning direction and in parallel with the color nozzle row, the black nozzle row being constituted of P black nozzle groups; and in a case where the amount of ink to be ejected from the black nozzle row is a predetermined value or greater, one raster is segmented among each of the black nozzle groups of the black nozzle row, and in a case where the amount of ink to be ejected from the black nozzle row is less than a predetermined value, one raster is printed by any one among the black nozzle groups.

* * * * *